US006084509A

United States Patent [19]

Simpson, Sr.

[11] Patent Number: 6,084,509

[45] Date of Patent: Jul. 4, 2000

[54] ANNUNCIATOR ALARM CONTROL DEVICE

[76] Inventor: Ronald R. Simpson, Sr., 7062 Wolff St., Westminster, Colo. 80030

[21] Appl. No.: 09/247,785

[22] Filed: Feb. 9, 1999

[51] Int. Cl.[7] ..... G08B 29/00

[52] U.S. Cl. ..... 340/506; 340/524; 340/825.36; 340/825.49

[58] Field of Search ..... 340/506, 524, 340/525, 531, 532, 533, 825.06, 825.31, 825.32, 825.36, 825.49

[56] References Cited

U.S. PATENT DOCUMENTS

| | | | |
|---|---|---|---|
| 3,866,194 | 2/1975 | Lawton et al. | 340/213 R |
| 3,958,240 | 5/1976 | Richardson | 340/413 |
| 4,118,700 | 10/1978 | Lenihan | 340/52 F |
| 4,158,839 | 6/1979 | Drobniak | 340/524 |
| 4,218,677 | 8/1980 | Wilson et al. | 340/505 |
| 4,274,087 | 6/1981 | Swanson et al. | 340/525 |
| 4,359,721 | 11/1982 | Galvin et al. | 340/525 |
| 4,423,410 | 12/1983 | Galvin et al. | 340/525 |
| 4,435,700 | 3/1984 | Ally | 340/539 |
| 4,470,039 | 9/1984 | McBrian | 340/514 |
| 4,524,349 | 6/1985 | Hyatt | 340/500 |
| 4,567,471 | 1/1986 | Acar | 340/513 |
| 4,625,198 | 11/1986 | Williamson et al. | 340/514 |
| 4,728,946 | 3/1988 | Sharples | 340/765 |
| 4,760,382 | 7/1988 | Faulkner | 340/572 |
| 5,311,168 | 5/1994 | Pease, Jr. et al. | 340/542 |
| 5,400,246 | 3/1995 | Wilson et al. | 340/825.06 X |

*Primary Examiner*—Daryl Pope
*Attorney, Agent, or Firm*—John L. Isaac; Isaac & Associates

[57] ABSTRACT

An apparatus is disclosed for use in a multi-zone alarm system having a single-pair wire alarm loop and programmable switching circuit arrangements. The apparatus includes a current source serially connected to the single-pair wire loop and selectively operative to provide a predetermined current signal in the loop. A plurality of zone sensing devices are arranged in a normally closed series circuit along the single-pair wire loop. Each of the zone sensing devices is adapted for generating coded voltage changes and alarm activation caused by an open circuit created therein. An element is provided for indicating the condition of each of the zone sensing devices, while a mechanism is provided for selectively arming and disarming the zone sensing devices. A circuit arrangement is provided for indicating an open circuit in the single-pair wire loop unrelated to the condition of the zone sensing devices, while another circuit is operative in response to the zone sensing devices to provide a signal indication of the zone in which alarm activation has occurred. Finally, a circuit mechanism is provided for continuously monitoring all circuit conditions of the apparatus in both the armed and disarmed operative conditions.

24 Claims, 14 Drawing Sheets

NORMALLY CLOSED CIRCUIT EXAMPLES

TRUTH TABLE

| | ZONES | | | SELECTOR SWITCHES | | | | | | | | | | | |
|---|---|---|---|---|---|---|---|---|---|---|---|---|---|---|---|
| L# | (ACTV. ANY) | / | (OR ACTV.) | 1 | 2 | 3 | 4 | 5 | 6 | 7 | 8 | 9 | 10 | 11 | 12 |
| 1 | A,B,C,D | / | -------- | ON | ON | ON | ON | ON | ON | OFF | OFF | OFF | OFF | OFF | OFF |
| 2 | A + B | / | C, OR D | OFF | ON | ON | OFF | ON | ON | ON | OFF | OFF | OFF | OFF | OFF |
| 3 | A + C | / | B, OR D | OFF | ON | ON | ON | OFF | ON | ON | OFF | OFF | OFF | OFF | OFF |
| 4 | A + D | / | B, OR C | OFF | ON | ON | ON | ON | OFF | OFF | OFF | ON | OFF | OFF | OFF |
| 5 | B + C | / | A, OR D | ON | OFF | ON | ON | OFF | ON | OFF | OFF | OFF | ON | OFF | OFF |
| 6 | B + D | / | A, OR C | ON | OFF | ON | ON | ON | OFF | OFF | OFF | OFF | OFF | ON | OFF |
| 7 | C + D | / | A, OR B | ON | ON | OFF | ON | ON | OFF | OFF | OFF | OFF | OFF | OFF | OFF |
| 8 | A + B | / | C + D | OFF | ON | OFF | OFF | ON | OFF | ON | OFF | OFF | OFF | OFF | ON |
| 9 | A + C | / | B + D | OFF | OFF | ON | ON | OFF | OFF | OFF | ON | OFF | OFF | ON | OFF |
| 10 | A + D | / | B + C | OFF | OFF | ON | ON | OFF | OFF | OFF | OFF | ON | ON | OFF | OFF |
| 11 | B + C | / | A + D | OFF | OFF | ON | ON | OFF | OFF | OFF | OFF | ON | ON | OFF | OFF |
| 12 | B + D | / | A + C | OFF | OFF | ON | ON | OFF | OFF | OFF | ON | OFF | OFF | ON | OFF |
| 13 | C + D | / | A + B | OFF | OFF | OFF | OFF | ON | OFF | ON | OFF | OFF | OFF | OFF | ON |
| 14 | A+B+C | / | D | OFF | OFF | ON | OFF | OFF | ON | ON | OFF | OFF | ON | OFF | OFF |
| 15 | B+C+D | / | A | ON | OFF | OFF | ON | OFF | OFF | OFF | OFF | OFF | ON | OFF | ON |
| 16 | A+B+C+D | / | -------- | OFF | OFF | OFF | OFF | OFF | OFF | ON | OFF | OFF | ON | OFF | ON |

FIG. 4

FIG. 4

| L# | (ACTV. ANY) | / | (OR ACTV.) | | OFF | 1 | 2 | 3 | 4 | 5 | 6 | 7 | 8 | 9 | 10 | 11 | 12 |
|---|---|---|---|---|---|---|---|---|---|---|---|---|---|---|---|---|---|
| 17 | A + B | / | C | / | D | OFF | ON | ON | OFF | ON | ON | ON | OFF | OFF | OFF | OFF | OFF |
| 18 | A + B | / | D | / | C | OFF | ON | ON | OFF | OFF | ON | ON | OFF | OFF | OFF | OFF | OFF |
| 19 | A + C | / | B | / | D | OFF | ON | ON | ON | OFF | OFF | OFF | ON | OFF | OFF | OFF | OFF |
| 20 | A + C | / | D | / | B | OFF | OFF | ON | OFF | OFF | ON | OFF | ON | OFF | OFF | OFF | OFF |
| 21 | A + D | / | B | / | C | OFF | ON | OFF | ON | OFF | OFF | OFF | OFF | ON | OFF | OFF | OFF |
| 22 | A + D | / | C | / | B | OFF | OFF | ON | OFF | ON | OFF | OFF | OFF | ON | OFF | OFF | OFF |
| 23 | B,C,D | / | -------- | / | A | OFF | ON | ON | ON | ON | ON | OFF | OFF | OFF | OFF | OFF | OFF |
| 24 | A,C,D | / | -------- | / | B | ON | OFF | ON | OFF | ON | ON | OFF | OFF | OFF | OFF | OFF | OFF |
| 25 | A,B,D | / | -------- | / | C | ON | ON | OFF | ON | OFF | ON | OFF | OFF | OFF | OFF | OFF | OFF |
| 26 | A,B,C | / | -------- | / | D | ON | ON | ON | ON | ON | OFF | OFF | OFF | OFF | OFF | OFF | OFF |
| 27 | C,D | / | -------- | / | A,B | OFF | OFF | ON | OFF | ON | ON | OFF | OFF | OFF | OFF | OFF | OFF |
| 28 | A,B | / | -------- | / | C,D | ON | ON | OFF | ON | OFF | OFF | OFF | OFF | OFF | OFF | OFF | OFF |
| 29 | D | / | -------- | / | A,B,C | OFF | OFF | OFF | OFF | OFF | ON | OFF | OFF | OFF | OFF | OFF | OFF |
| 30 | -------- | / | -------- | / | A,B,C,D | OFF | OFF | OFF | OFF | OFF | OFF | OFF | OFF | OFF | OFF | OFF | OFF |
| | | | | | | 1 | 2 | 3 | 4 | 5 | 6 | 7 | 8 | 9 | 10 | 11 | 12 |

LEGEND:

L# = LINE NUMBER, 1-30
ACTV.= ACTIVATE
1-12 = SELECTOR SWITCH NUMBER
+ = BOTH / ALL MUST BE ACTIVATED
OR = EITHER, SHALL CAUSE ACTIVATION
OFF = ZONE OFF
A,B,C,D = ZONE A,B,C,D

ZONE / VOLTAGE TABLE

| | ZONE (OPEN) | ZONE (CLOSED) | OHMS (SWITCH RES.) | TOTAL (OHMS) | EQUAL (VOLTS) |
|---|---|---|---|---|---|
| 1 | ----- | A,B,C,D | 000+250 | 250 | 2.5 |
| 2 | A | B,C,D | 100+250 | 350 | 3.0 |
| 3 | B | A,C,D | 200+250 | 450 | 3.5 |
| 4 | A,B | C,D | 300+250 | 550 | 4.0 |
| 5 | C | A,B,D | 400+250 | 650 | 4.5 |
| 6 | A,C | B,D | 500+250 | 750 | 5.0 |
| 7 | B,C | A,D | 600+250 | 850 | 5.5 |
| 8 | A,B,C | D | 700+250 | 950 | 6.0 |
| 9 | D | A,B,C | 800+250 | 1050 | 6.5 |
| 10 | A,D | B,C | 900+250 | 1150 | 7.0 |
| 11 | B,D | A,C | 1000+250 | 1250 | 7.5 |
| 12 | A,B,D | C | 1100+250 | 1350 | 8.0 |
| 13 | C,D | A,B | 1200+250 | 1450 | 8.5 |
| 14 | A,C,D | B | 1300+250 | 1550 | 9.0 |
| 15 | B,C,D | A | 1400+250 | 1650 | 9.5 |
| 16 | A,B,C,D | ---- | 1500+250 | 1750 | 10.0 |

| ZONE | OHMS RES. |
|---|---|
| A | 100 |
| B | 200 |
| C | 400 |
| D | 800 |

FIG. 5

ANNUNCIATOR ALARM CONTROL DEVICE

BACKGROUND OF THE INVENTION

1. Field of the Invention

This invention relates to alarm systems and, more particularly, to a multi-zone alarm system for the detection and indication of an alarm condition in variously identified zones. Specifically, the present invention relates to an improved alarm system which monitors multiple zones with normally closed circuit sensing devices in a series connected circuit by means of a single pair wire.

2. Description of the Prior Art

In alarm systems employed to sense intrusion, fire or other conditions, techniques are known for the determination at a central location of the remote zone in which an alarm has occurred. Examples of such systems are illustrated in U.S. Pat. No. 4,274,087, No. 4,625,198 and No. 4,728,946. In such systems, a communications path is a generally established between each remote alarm sensor and a central location, the communications path being provided by means of a separate communications line from the central location to each remote station, or by use of a common communications line and multiplexed signaling techniques, such as time division multiplexing or frequency division multiplexing.

It is advantageous to employ a two-wire communications path forming a single alarm loop in which all alarm sensors are connected. Such a single loop can minimize the amount of wiring necessary to interconnect the central location with the remote sensors and can provide relatively simple and efficient connection of the remote sensors with the central location. It is typically required in an alarm system to provide the capability of identifying each sensor or each zone in which an alarm has occurred, and an example of this type of system is disclosed in U.S. Pat. No. 4,423,410. However, there remains quite a few drawbacks and limitations to existing two-wire systems available on the market including the ability to function both in the armed and disarmed modes as well as to indicate when the system has been cut during its disarmed mode.

SUMMARY OF THE INVENTION

Accordingly, it is a primary object of the present invention to disclose a means of detecting and identifying a plurality of zones and provide indication of all conditions thereof.

It is another object of the present invention to provide a method of determining said conditions supplied from a single pair wire.

It is another object of the present invention to provide a device for determining the difference of any and all openings of the zoned loop, and a cut open loop condition, and provide indication thereof.

It is a further object of the present invention to provide a technique of selecting, or programming, all possible circuit arrangements of the zoned devices without the need of physical rewiring.

It is yet a further object of the present invention to provide a decoding receiver and annunciator providing indication as to conditions thereof.

It is also a further object of the present invention to provide a device for coding any utilized normally closed circuit device by means of placing a specific predetermined value resistor in a parallel circuit across the normally closed device switch.

It is also a further object of the present invention to provide a method of revising a single pole single throw switch to produce a two-state switch having a low and high state of resistance.

It is also a further object of the present invention when utilizing a four-zone detection system to provide the means of identification of all sixteen possible circuit combinations thereof.

It is also a further object of the present invention to provide a two-state mode of operation of the system, the operations being "Disarmed" and "Armed" modes.

It is also a further object of the present invention to provide a device which continuously monitors all circuit conditions in both modes of operations.

It is also a further object of the present invention to provide a means to latch on, or hold, any light emitting diode indicators which are activated while the system is in the "Armed" mode of operations.

It is also a further object of the present invention to provide a means to hold on any latched-on light emitting diode indicators which occur during the "Armed" mode, and to hold on any of such indicators when the system is "Disarmed".

It is also a further object of the present invention to provide a means of re-setting all latched-on light emitting diodes which have been activated during the "Armed" mode, the reset switch being reset only in the "Disarmed" mode of operations.

It is also a further object of the present invention to provide a means of determining whether and which zoned circuits are activated, if any of the zoned devices are presently open or closed, and if an alarm activation has occurred.

It is also a further object of the present invention to provide a means of monitoring all conditions during the "Disarmed" mode of operations with such conditions including all zoned circuit devices being open or closed circuit, closed loop circuit wire cut, low or no voltage to the system, system normal, loop circuit normal and closed, loop circuit voltage normal, and system mode being "Armed" or "Disarmed".

To achieve the foregoing and other objects and in accordance with the purpose of the present invention, as embodied and broadly described herein, an apparatus is disclosed for use in a multi-zone alarm system having a single-pair wire alarm loop and programmable switching circuit arrangements. The apparatus includes a current source serially connected to the single-pair wire loop and selectively operative to provide a predetermined current signal in the loop. A plurality of zone sensing devices are arranged in a normally closed series circuit along the single-pair wire loop. Each of the zone sensing devices is adapted for generating coded voltage changes and alarm activation caused by an open circuit created therein. An element is provided for indicating the condition of each of the zone sensing devices, while a mechanism is provided for selectively arming and disarming the zone sensing devices. A circuit arrangement is provided for indicating an open circuit in the single-pair wire loop unrelated to the condition of the zone sensing devices, while another circuit is operative in response to the zone sensing devices to provide a signal indication of the zone in which alarm activation has occurred. Finally, a circuit mechanism is provided for continuously monitoring all circuit conditions of the apparatus in both the armed and disarmed operative conditions.

In a more specific embodiment utilizing four zone sensing devices, the control system provides for decoding any and all sixteen possible switching circuit arrangements of the four-zoned devices. The system also provides a mechanism for programming any and all of the thirty possible zone circuit switching configurations while further permitting more than one zoned device to be activated to cause an alarm condition. The system also provides a two-mode operation, "Disarmed" and "Armed", in addition to the twenty-four hour monitoring of all conditions. Finally, the system provides a circuit arrangement for reducing false alarms caused by short-term momentary opening detected in the zoned loop circuit.

BRIEF DESCRIPTION OF THE DRAWINGS

The accompanying drawings which are incorporated in and form a part of the specification illustrate a preferred embodiments of the present invention and, together with a description, serve to explain the principles of the invention. In the drawings:

FIG. 4 is a truth table of programming the selector switches of a preferred embodiment of the invention;

FIG. 5 is a zone/voltage table of a preferred embodiment of the present invention;

DETAILED DESCRIPTION OF THE PREFERRED EMBODIMENTS

Referring in general to the Figures, the system of the invention detects and identifies any and all circuit openings which become open circuit. Each zoned circuit provides indication of all conditions of each of the four-zoned devices by means of four light emitting diodes which monitor continuously, twenty-four hours a day. In preferred form, the system has two modes of operation, "Armed" and "Disarmed". When in the "Disarmed" mode, should any of the zoned circuits become open, the associated zone light emitting diode becomes on, and upon closure the zone indicators return to off and do not latch on. In such an event, an alarm condition shall not occur.

When the device is in the "Armed" mode, any opening shall be indicated as being on and become latched-on and remain on until manually reset once the system has been returned to the "Disarmed" mode of operation. When the device is in the "Armed" mode, should an opening or openings occur which meet the criteria as programmed by the twelve combination switches, such an event will cause alarm activation.

Figure 6:
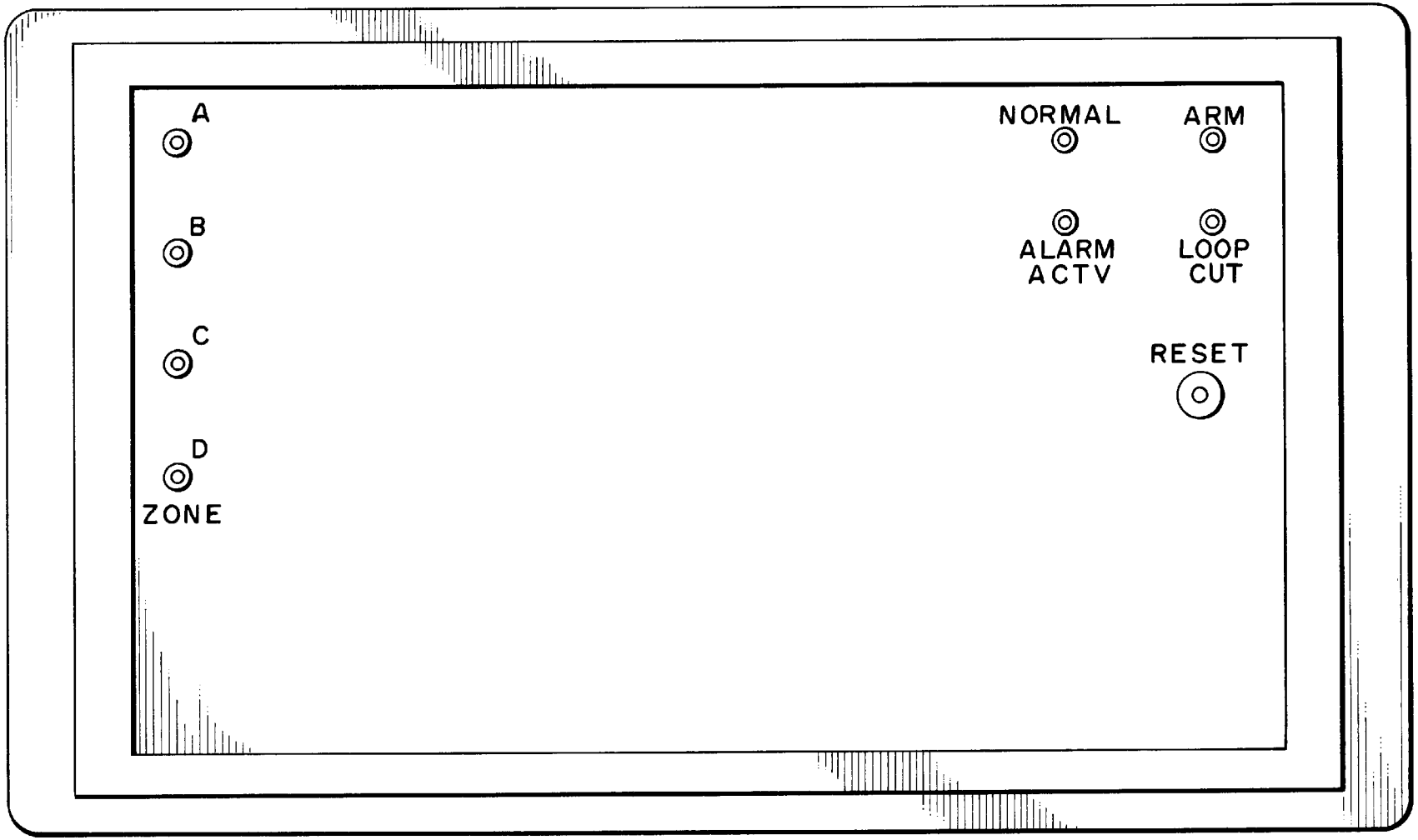
FIG. 6 is a front plan view of the cover assembly of an apparatus constructed in accordance with the present invention.
Figure 7:
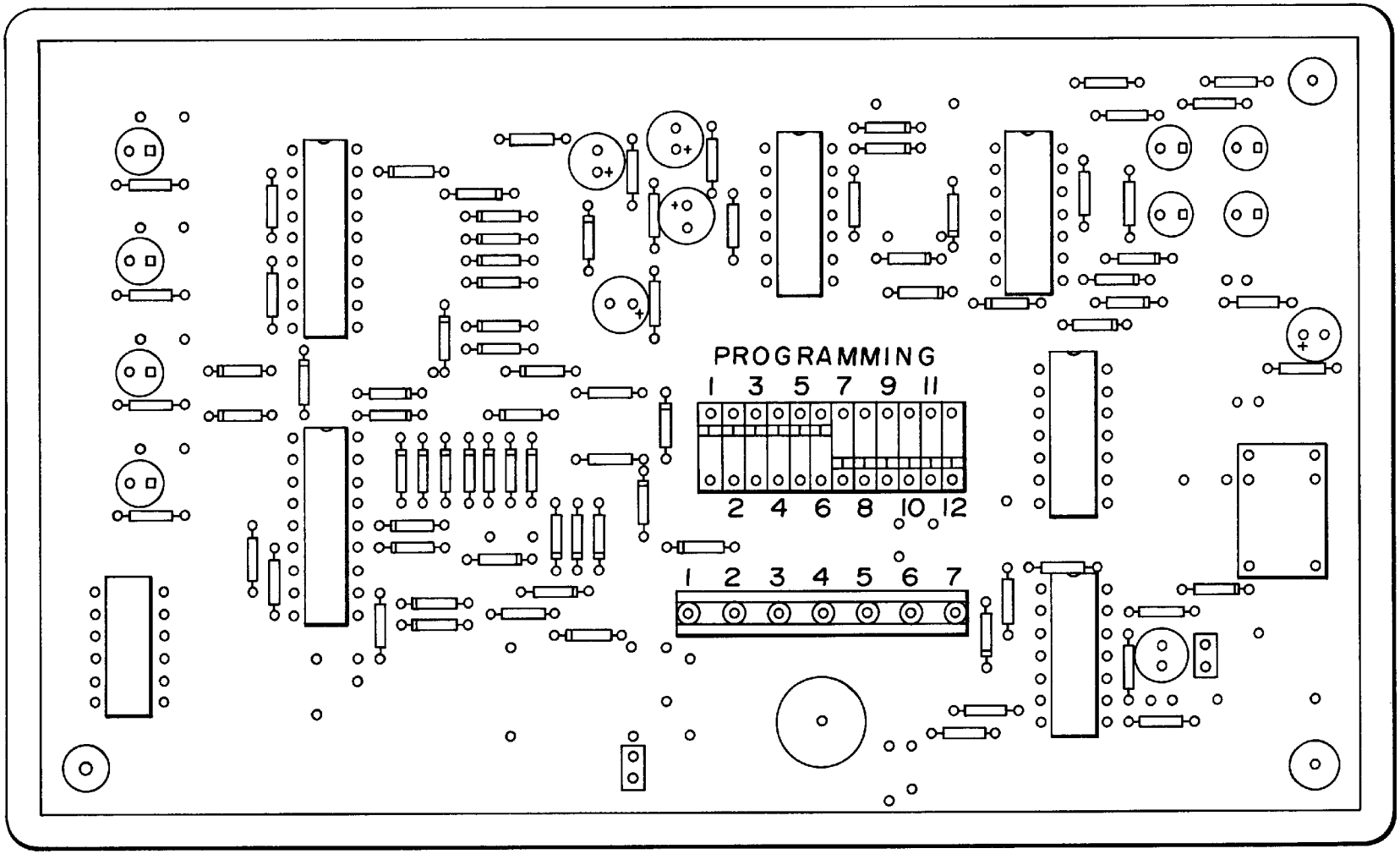
FIG. 7 is a front plan view of the interior of the apparatus of the invention incorporating the circuitry illustrated in FIGS. 1 and 2.

Referring particularly, now, to FIGS. 6 and 7, since the system monitors all conditions twenty-four hours per day, and when in the "Disarmed" mode of operation, another distinct advantage is that any of the zoned closed circuit devices monitored provides a means of testing each utilized device. Moreover, the system provides complete monitoring of all conditions provided by eight separate colored light emitting diode indicators. Furthermore, four amber light emitting diodes provide indication as to the condition of each of the four-zoned devices.

The green light emitting diode, normally ON, indicates all zoned circuits are closed and the supply voltage to the system is normal. When OFF, it indicates one or more zoned circuits are open, and the open zones are indicated. When all zone indicators are Off and the green indicator is OFF, this indicates loss of power to the system. The orange light emitting diode provides indication as to the modes of operation. When OFF, it indicates the system is in the "Disarmed" mode of operation, and when ON, it indicates the system is in the "Armed" mode.

Two red light emitting diodes are provided. The first red indicator provides indication of alarm condition. When Off, condition is normal, and when ON, it indicates that an alarm activation has occurred. Once activated, the indicator is latched-on, and remains on until the system has been "Disarmed," at which point the reset switch is pressed. The second red indicator provides an indication of continuity of the closed circuit zone loop. When Off, it indicates that the system is normal. When ON, it indicates that the zoned closed loop circuit is open due to a cut wire. This circuit operates continuously in either mode of operation, "Armed" or "Disarmed", thereby providing early warning of a problem when in "Disarmed" mode. When in the "Armed" mode, an alarm activation would occur at the time the wire is cut open.

Figure 1:
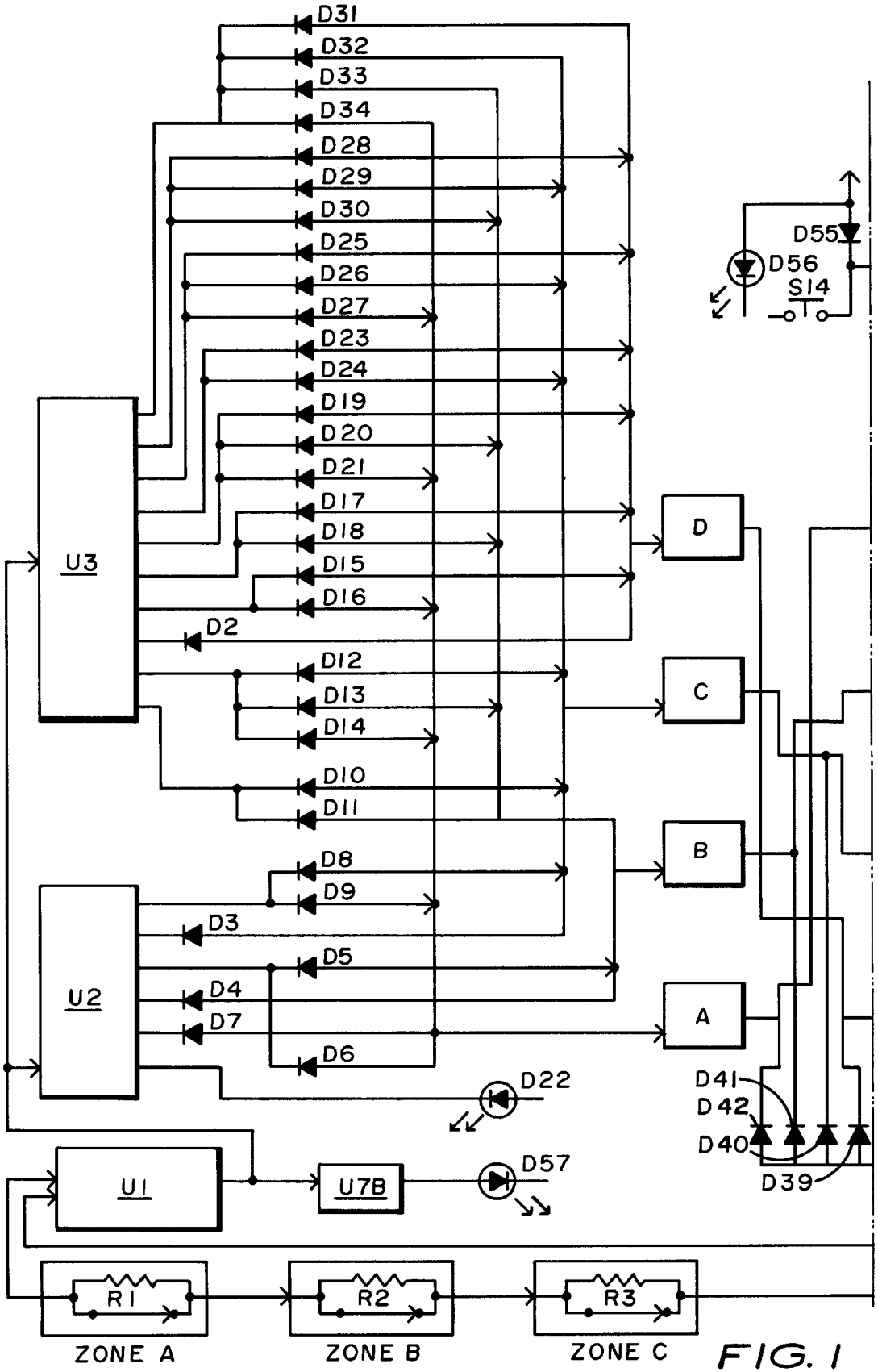
FIG. 1 is a block diagram of a preferred embodiment of the present invention.
Figure 1:
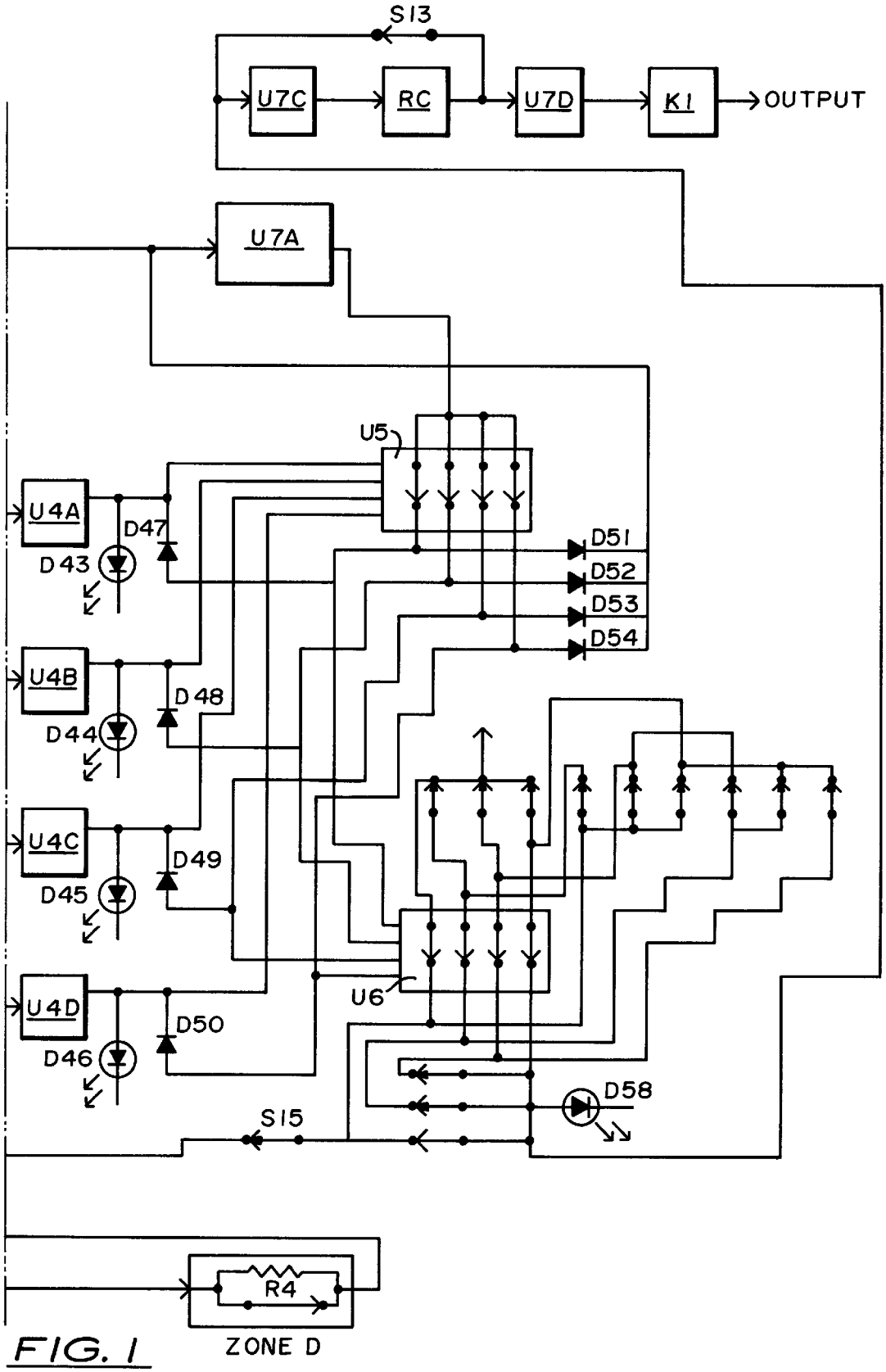
Figure 2A:
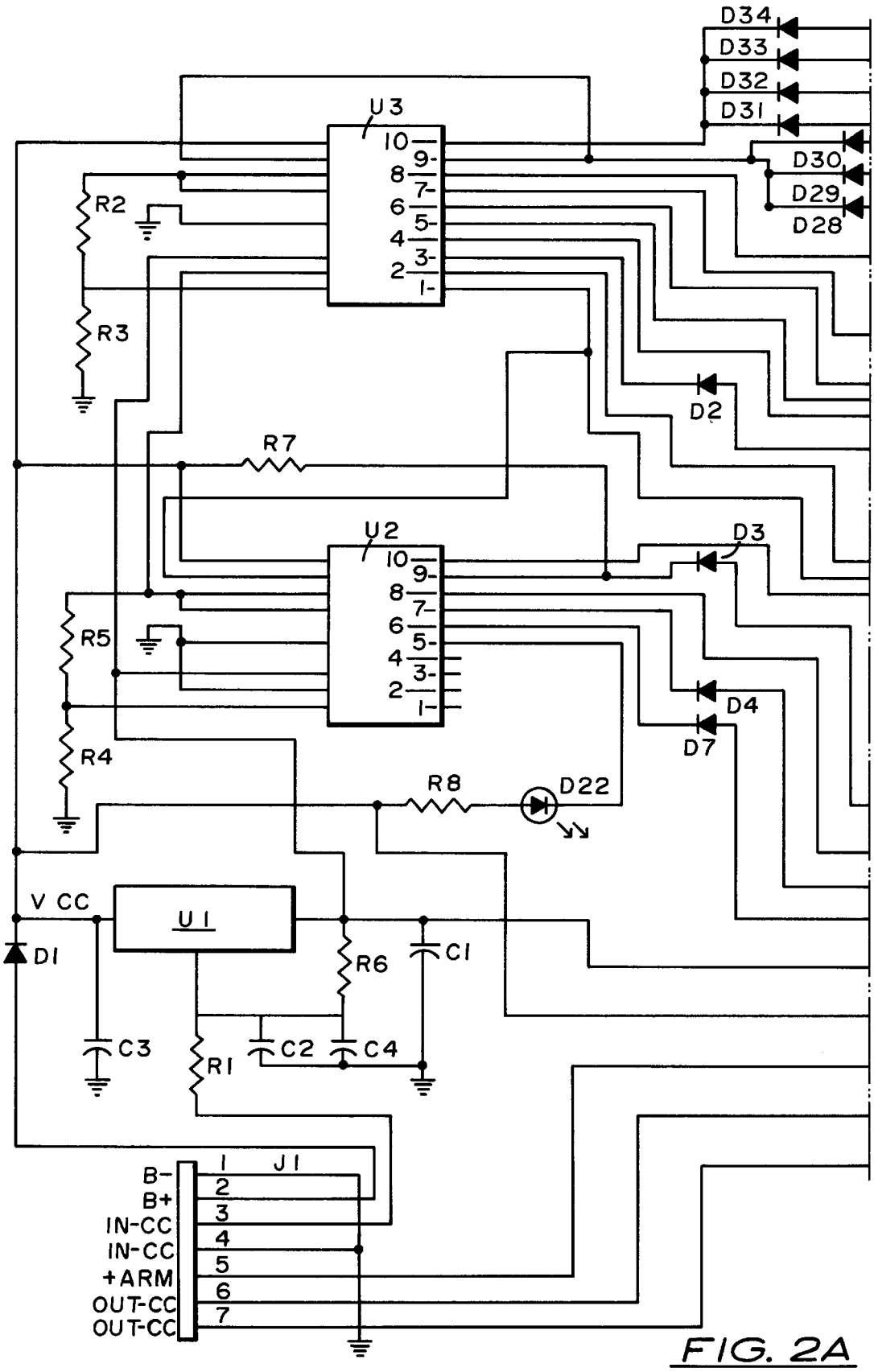
FIG. 2A is a first partial circuit schematic of a preferred embodiment of the present invention.
Figure 2A:
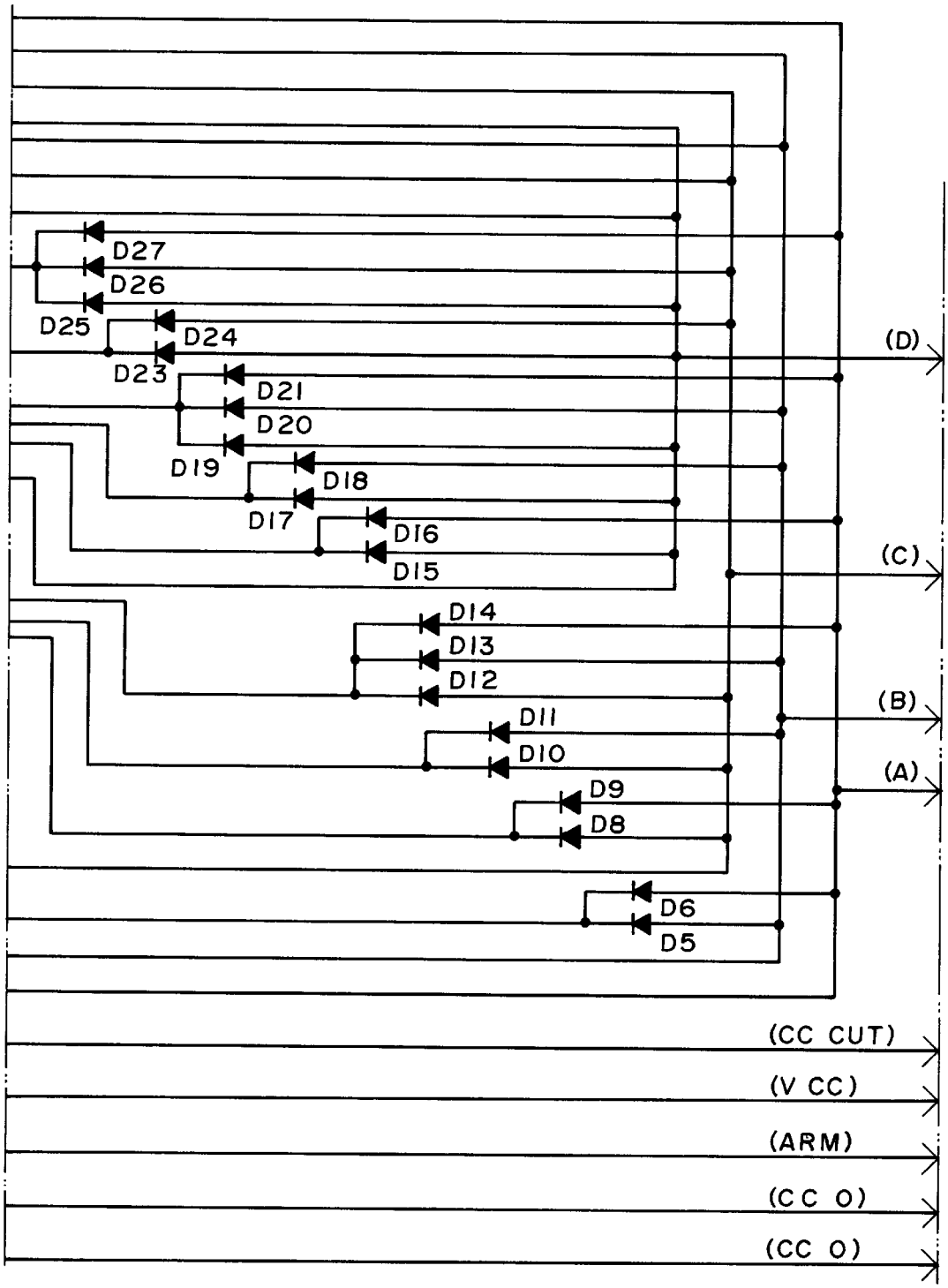
Figure 2B:
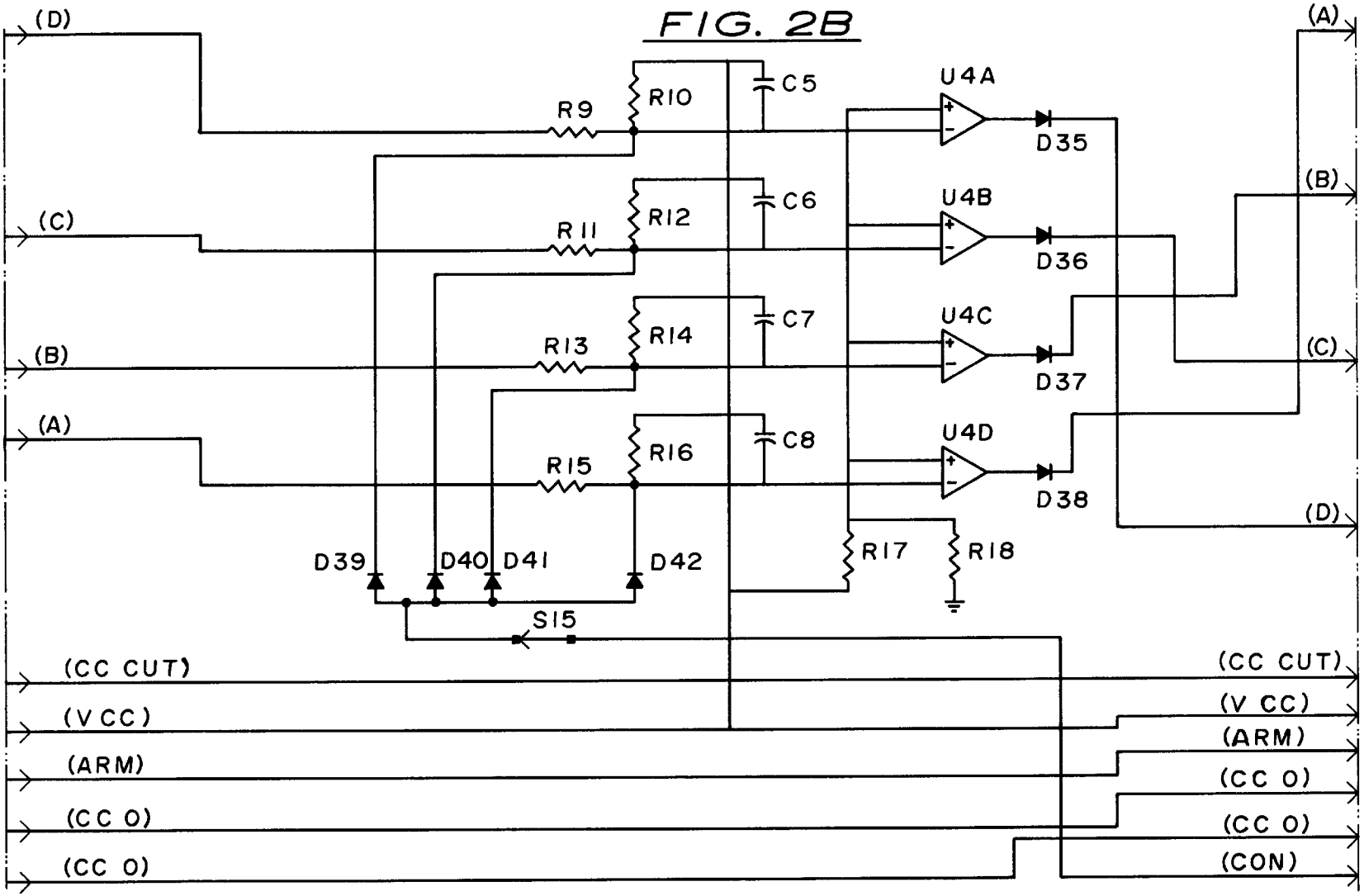
FIG. 2B is a continuation of the partial circuit schematic of the preferred embodiment illustrated in FIG. 2A.
Figure 2C:
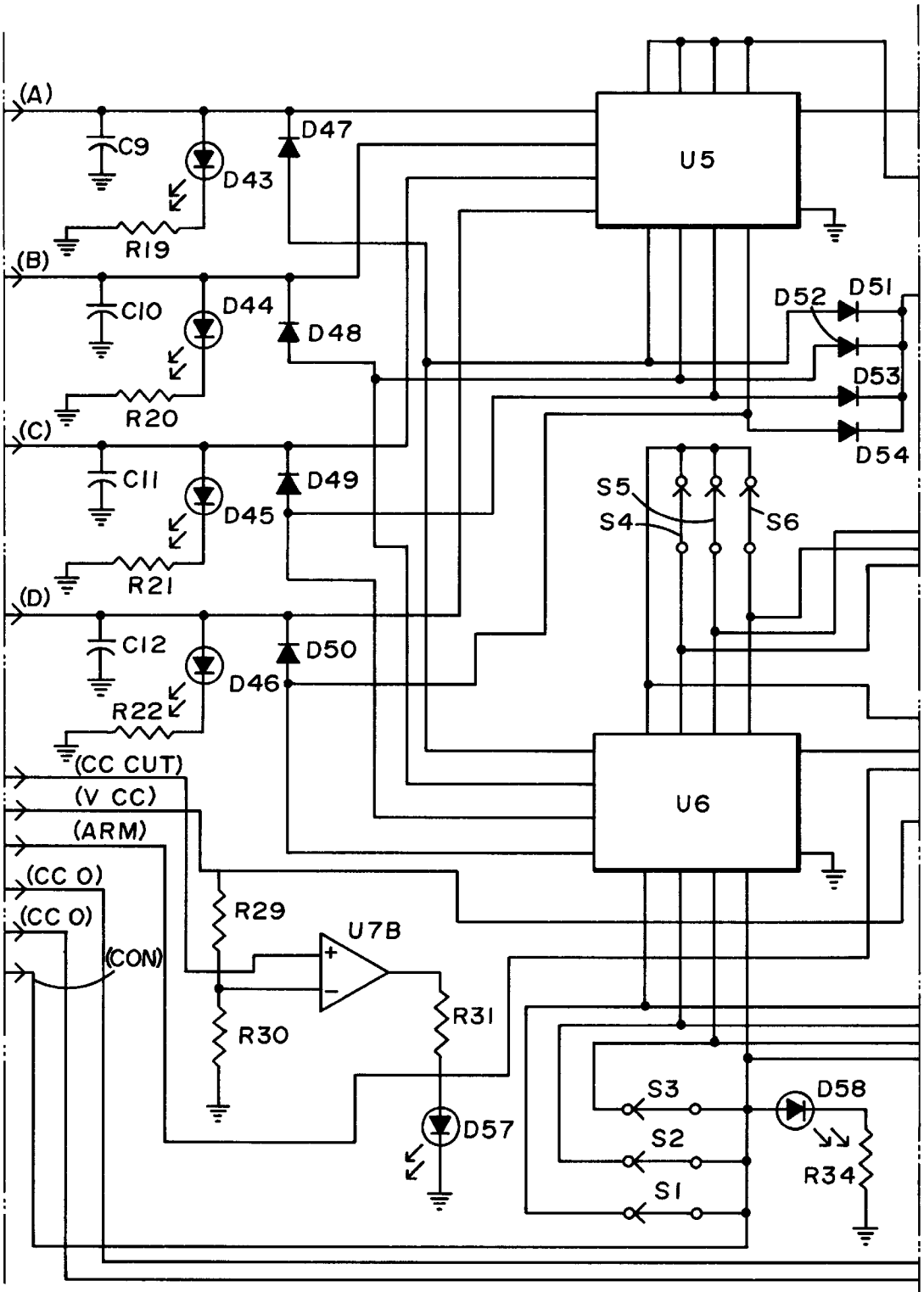
FIG. 2C is a continuation of the partial circuit schematic of the preferred embodiment illustrated in FIG. 2B.
Figure 2C:
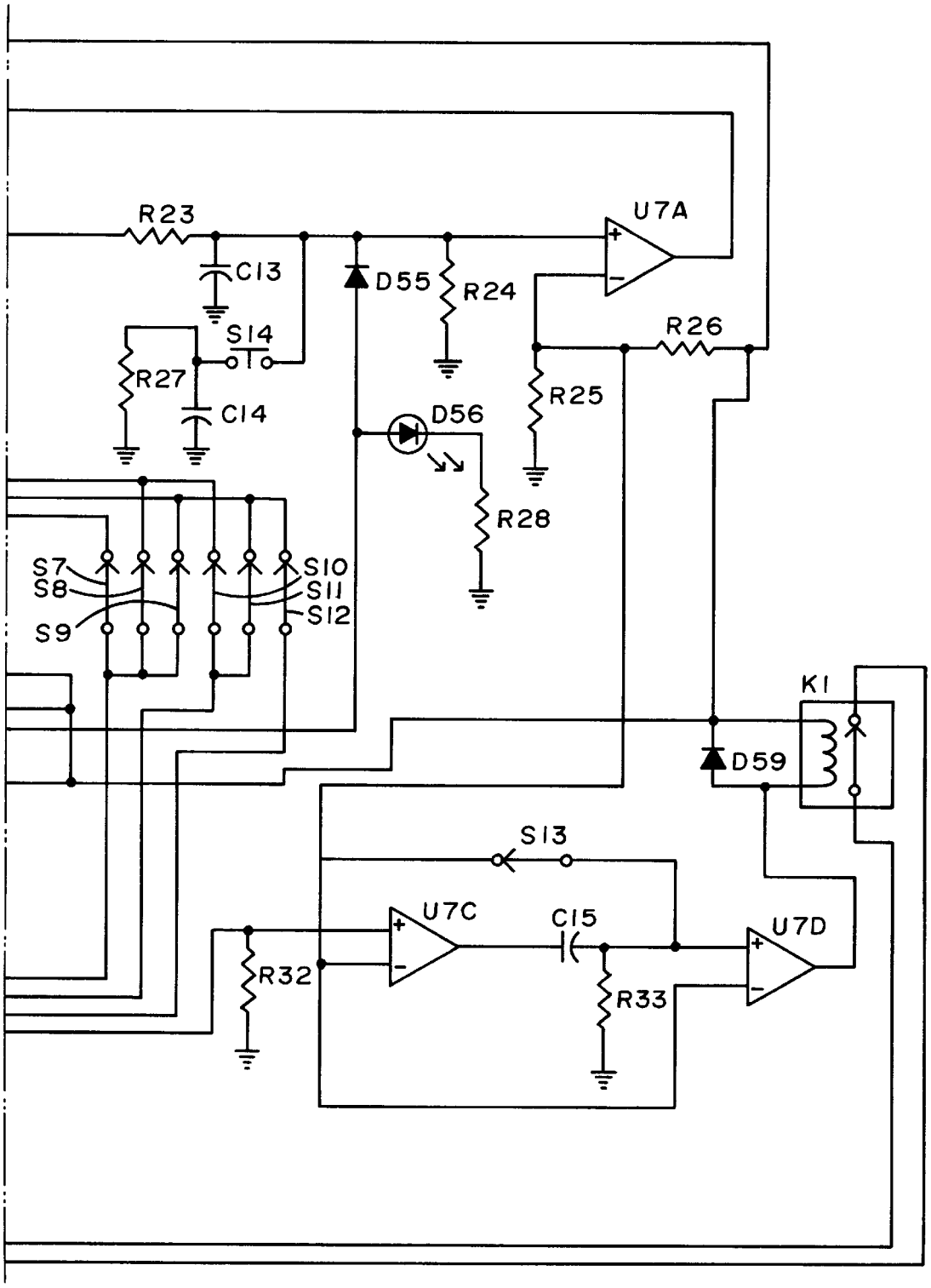

Referring now in particular to FIGS. 1 and 2, a first preferred embodiment of the present invention is illustrated and shall be described. The system of the invention is primarily designed to be utilized in conjunction with most alarm control panels. The control panel should be capable of monitoring a normally closed circuit and provide a filtered twelve volt direct current as well as having a battery back-up system. It should also provide a positive potential output when the system is in the "Armed" mode of operation.

The system of the invention is preferably designed to operate at 12 V.D.C. @ 100 MA. The negative potential from the main control panel is connected to wiring terminal block #1 of the system, while the positive potential is connected to the terminal block #2. The positive anode of diode D1 is connected to terminal block #2 positive potential (B+), and the negative cathode is connected to the input of the linear voltage regulator U1. The voltage input is also connected to a by-pass capacitor C2, having the cathode connected to negative potential ground. The positive voltage also supplies a positive potential to U2, U3, U4, U5, U6, U7, and further points as shall later be described.

Referring to the linear voltage regulator U1, the voltage adjust input is connected to resistor R6 which returns to the voltage output of U1. Resistor R1 is connected to the voltage adjust input which returns to terminal block J1, terminal #3, being the normally closed series loop circuit input. The return side of the loop circuit is connected to terminal #4 of J1, which is connected to negative potential, ground. Resistors R1 and R6 determine the minimum and maximum output voltage of U1. As designed and illustrated, the minimum output voltage of U1 is preferably 2.5 volts, which occurs when all of the zoned circuits are closed. The maximum voltage is preferably 10 volts, which occurs when all of the zoned circuits are open.

Each of the four zoned closed circuit devices utilized in the illustrated embodiment include a specific zone coding resistor connected in parallel to the normally closed contacts, those being the input and output of each zoned circuit. Each of the four zone resistors are of a calculated value so as to produce voltage outputs from 2.5 through 10.0 volts, in divisions of 0.5 volts, thereby providing a means of determining all four zoned circuit combinations, being sixteen (16). FIG. 5, a zone/voltage table, clearly illustrates this aspect of the preferred embodiment.

The voltage adjust input of U1 is connected to the positive anodes of two capacitors being C3 and C4, and the negative cathode of each capacitor is connected to ground. These capacitors filter transient signals in the loop circuits. The voltage output of U1 is connected to the input of the $2^{nd}$ operational amplifier U7, which circuit is described in greater detail below. The voltage output of U1 is connected to the positive anode of capacitor C1, while the negative cathode is connected to ground. The capacitor C1 provides filtering of the output voltage.

The voltage output of U1 is also connected to the inputs of both U2 and U3. The two integrated circuits are Dot Display Drivers, and each contains its own adjustable reference and accurate ten step voltage divider. These drivers are connected in a cascading circuit arrangement. U2 is designed to provide voltage detection and indication of 0.5 through 5.0 volts, in segments of 0.5 volts. The R-high and the R-low of both U2 and U3 are connected together where R-high and R-low are the ends of the divider chain. The reference voltage output is preferably 1.25 volts.

The R-high determines the voltage as produced from the $10^{th}$ comparator of U2 to be 5.0 volts as set by R4, which is connected from pin #6 and #7, #6 being the high voltage set and #7 being the reference out. R4 returns to pin #8 being the reference adjust, which is set at 1.25 volts by R5 and connected from pin #8 to ground, negative potential.

The second Dot Display Driver U3 is connected in the same manner, where R2 is connected to pins #6 and #7 and returns to pin #8, which sets the $10^{th}$ comparator at 10.0 volts. R3 is connected from pin #8 to ground, which sets the low input voltage of the $1^{st}$ comparator at 5.5 volts.

The combined two Dot Display Drivers provide the means to indicate input to output voltages in divisions of 0.5 volts, from 0.5 through 10.0 volts. The twenty comparators outputs of the combined U2 and U3 are now described. The outputs of U2, 0.5, 1.0, 1.5, 2.0 volts, pin #1,18,17,16 are not currently utilized in the illustrated example. The 2.5 volt output (pin #15) is connected to the cathode of a Light Emitting Diode (L.E.D.), D22, and the positive anode is connected to R8 and returns to positive potential. The L.E.D. D22 provides the indication of all zoned circuits to be normal and closed. It also indicates when the loop resistance and voltage is normal.

The 3.0 volt output (pin #14) is connected to the negative cathode of D7. Moreover, the positive anode is connected to R15 which returns to the input of the $4^{th}$ operational amplifier of U4, which represents zone A. This input is also connected to R16 and the cathode of C8, which are both connected to the positive potential Vcc. R15, R16 and C8 form an R.C. circuit, and where a negative signal is applied, it must be a continuous signal in excess of two seconds to cause a change of state of the operational amplifier output from a normal negative state to a positive state. Each of the four operational amplifiers inputs of U4 are essentially and preferably the same. The operation and processing of U4 shall be later described.

Each of the said four operational amplifiers represent the four zones of the loop circuit and are indicated by A, B, C, D. The 3.5 volt output (pin #13) is connected to the negative cathode of D4, the positive anode is connected to R13 which returns to the input of the $3^{rd}$ operational amplifier of U4, being representative of zone B. This input is also connected to R14 which returns to positive potential and is also connected to the cathode of C7. The anode is connected to positive potential Vcc.

The 4.0 volt output (pin #12) is connected to the cathode of D5, while the anode is connected to R13 which returns to the input of the $3^{rd}$ operational amplifier of U2, being zone B. The 4.0 volt output (pin #12) is also connected to the cathode of D6, while the anode is connected to R15 which returns to the input of $4^{th}$ input of U2, being representative of zone A.

The 4.5 volt output (pin #11) is connected to the cathode of D3, and the anode is connected to R11 which returns to the input of the $2^{nd}$ operational amplifier of U2, being zone C. The output (pin #11) is also connected to R7, which returns to Vcc and determines the Dot mode of operation.

The 5.0 volt output (pin #10) is connected to the cathode of D8, and the anode returns to R11 which returns to the input of the $2^{nd}$ operational amplifier of U4, being representative of zone C. This input is also connected to R12, which returns to Vcc, as well as being connected to the cathode of C6. The anode is connected to Vcc. The 5.0 volt output is also connected to the cathode of D9, and the anode is connected to R15 which returns to the input of the $4^{th}$ operational amplifier of U4, being representative of zone A. The voltage outputs of U3 provide output voltages in divisions of 0.5 volts, being 5.5 volts through 10.0 volts.

The 5.5 volt output (pin #1) is connected to the mode (pin #9) of U2, determining the Dot mode of operation. The 5.5 volt output is also connected to the cathode of D10, and the anode is connected to R11 which returns to the input of the $4^{th}$ operational amplifier of U4, being representative of zone C. The 5.5 volt output is also connected to the cathode of D11, and the anode is connected to R13 which returns to the input of the $3^{rd}$ operational amplifier of U4, being representative of zone B.

The 6.0 volt output (pin #18) is connected to the cathode of D12, and the anode is connected to R11 which returns to the input of the second operational amplifier of U4, being representative of zone C. The 6.0 volt output is also connected to the cathode of D13, and the anode is connected to R13 which returns to the input of the $3^{rd}$ operational amplifier, being representative of zone B. The 6.0 volt output is also connected to the cathode of D14, and the anode is connected to R15 which returns to the input of the $4^{th}$ operational amplifier, being representative of zone A.

The 6.5 volt output (pin #17) is connected to the cathode of D2, and the anode is connected to R9 which returns to the input of the $1^{st}$ operational amplifier, being representative of zone D.

The 7.0 volt output (pin #16) is connected to the cathode of D15, and the anode is connected to R9 which returns to the input of the $1^{st}$ operational amplifier, being representative of zone D. The 7.0 volt output is also connected to the cathode of D16, and the anode is connected to R15 which returns to the input of the $4^{th}$ operational amplifier, being representative of zone A.

The 7.5 volt output (pin #15) is connected to the cathode of D17, and the anode is connected to R9 which returns to the input of the 1st operational amplifier, being representative of zone D. The 7.5 volt output is also connected to the cathode of D18, and the anode is connected to R13 which returns to the input of the 3rd operational amplifier, being representative of zone B.

The 8.0 volt output (pin #14) is connected to the cathode of D19, and the anode is connected to R9 which returns to the input of the 1st operational amplifier, being representative of zone D. The 8.0 volt output is also connected to the cathode of D20, and the anode is connected to R13 which returns to the input of the 3rd operational amplifier, being representative of zone B. The 8.0 volt output is also connected to the cathode of D21, and the anode is connected to R15 which returns to the input of the 4th operational amplifier, being representative of zone A.

The 8.5 volt output (pin #13) is connected to the cathode of D23, and the anode is connected to R9 which returns to the input of the 1st operational amplifier, being representative of zone D. The 8.5 volt output is also connected to the D24, and the anode is connected to R11 which returns to the input of the 2nd operational amplifier, being representative of zone C.

The 9.0 volt output (pin #12) is connected to the cathode of D25, and the anode is connected to R9 which is connected to the input of the 1st operational amplifier, being representative of zone D. The 9.0 volt output is also connected to the cathode of D26, and the anode is connected to R11 which returns to the input of the 4th operational amplifier, being representative of zone C. The 9.0 volt output is also connected to the cathode of D27, and the anode is connected to R15 which returns to the input of the 4th operational amplifier, being representative of zone A.

The 9.5 volt output (pin #11) is connected to the cathode of D28, and the anode is connected to R9 which returns to the input of the 1st operational amplifier, being representative of zone D. The 9.5 volt output is also connected to the cathode of D29, and the anode is connected to R11 which returns to the input of the 2nd operational amplifier, being representative of zone C. The 9.5 volt output is also connected to the cathode of D30, and the anode is connected to R13 which returns to the input of the 3rd operational amplifier, being representative of zone B.

The 10.0 volt output (pin #10) is connected to the cathode of D31, and the anode is connected to R9 which returns to the input of the 1st operational amplifier, being representative of zone D. The 10.0 volt output is also connected to the cathode of D32, and the anode is connected to R11 which returns to the input of the 2nd operational amplifier, being representative of zone C. The 10.0 volt output is also connected to the cathode of D33, and the anode is connected to R13 which returns to the input of the 3rd operational amplifier, being representative of zone B. The 10.0 volt output is also connected to the cathode of D34, and the anode is connected to R15 which returns to the input of the 4th operational amplifier, being representative of zone A.

The operations of U2, U3 and U4 are now described in detail. The voltage output's of U2 and U3 in a normal condition, being off, produce a positive output. When any or all of the twenty output voltages become activated, they produce a negative potential at the corresponding outputs, thereby changing the output state from positive to negative. The outputs are connected to diodes which allow only negative potential to pass forward. Each of the diodes are connected to a particular zone #, being A, B, C or D inputs of U4. The design as illustrated provides a means to produce voltages of 0.5 through 10.00, in divisions of 0.5 volts. See FIG. 5, Zone/voltage table.

U4 is designed as an inverting comparator, containing four separate operational amplifiers. The first amplifier represents Zone D, while the second represents zone C, the third represents zone B, and the fourth represents zone A. The normal condition being off, the output state is negative potential. The negative inputs of the four operational amplifiers are normally a positive potential as provided by resistors R10, R12, R14, and R16. The voltage reference of the four comparators are determined by resistors, R17 and R18.

When a negative signal is received at any of the four input resistors, R9, R11, R13, and R15, it returns to the respective four R.C. circuits, designed at two seconds. Therefore, the applied negative potential must exceed two seconds to cause a change of state of any of the four outputs of U4.

The output of the 1st comparator is connected to the anode of D35, and the cathode is connected to the control input, zone A of U5, being a quad bilateral switch utilized as a data selector. The control input is also connected to the cathode of C9, and the cathode is connected to ground. The control input is also connected to the anode of D43, and the cathode is connected to R19, which returns to ground. This determines the voltage applied to an amber L.E.D., indicating zone A.

The output of the 2nd comparator is connected to the anode of D36, and the cathode is connected to the control input of zone B. The control input is connected to the cathode of C10, and the anode is connected to ground. The control input is also connected to the cathode of D44, and the anode is connected to R20, which returns to ground and determines the voltage to the amber LED, D44, which indicates zone B.

The output of the 3rd comparator is connected to the anode of D37, and the cathode is connected to the control input of zone C. The control input is connected to the cathode of C11, and the anode is connected to ground. The control input is also connected to the anode of D45, and the cathode is connected to R21, which returns to ground and determines the voltage of the amber LED, D45, which indicates Zone C.

The output of the 4th comparator is connected to the anode of D38, and the cathode is connected to the control input of zone D. The control input is connected to the cathode of C12, and the anode is connected to ground. The control input is also connected to the anode of D46, and the cathode is connected to R22, which returns to ground and determines the voltage to the amber LED, D46, which indicates Zone D.

Capacitors C9, C10, C11, and C12 provide filtering of voltage spikes in the input circuits of U5. The control input of U5, zone A, is connected to the cathode of D47, and the anode is connected to output A of U5. The A output is also connected to the anode of D51, and the cathode is connected to the input of R23, which returns to the + input of the 1st operational amplifier of U7, utilized as a comparator. The control input B is connected to the cathode of D48, and the anode is connected to output of B, of U5, with the cathode being connected to the input of R23. The control input C is connected to the cathode of D49, and the cathode is connected to the output of C, of U5, with the anode being connected to the input of R23. The control input of D is connected to the cathode of D50, and the anode is connected to the output of D, of U5, with the anode being connected to the input of R23.

In describing the operations of U5, and U7, the 1st operational amplifier of U7 is designed as a non-inverting comparator. The return of R23 is connected to the + input of the 1st comparator. The input is also connected to the anode of C13, and the cathode is connected to ground. C13 provides filtering of the input of U5. The input is also connected to R24, and this returns to ground. R24 provides negative potential to the input. Therefore, the normal output state is negative potential, but when a positive potential is applied to the positive input, this changes the output to positive potential.

The positive input is also connected to the cathode of D56, and the cathode is connected to terminal #5 of J1, being the "Arm" and "Dis-Armed" mode of operation. Terminal #5 of J7 is also connected to the anode of D56, being an amber LED indicating mode of operation. The cathode is connected to R28, which returns to ground. R28 determines the voltage to D56. When in the "Armed" mode, a positive potential is applied to the positive input and causes the output to be positive potential. This output is connected to Input A, Input B, Input C, and Input D of U5 and thereby applies a positive potential to the output as determined by the control inputs.

The negative input of U7 is connected to R25, which returns to ground. The input is also connected to R26, which returns to Vcc. The resistors determine the voltage threshold of the positive input. The negative input is also connected to the negative inputs of the $3^{rd}$ and $4^{th}$ comparators of U7, which shall later be described.

When a positive potential from U4, zone A is received at the control input of zone A of U5, and when in the "Armed" mode of operation, it applies a positive potential to zone A output, which applies positive potential to the anode of D47. The cathode applies the positive potential to control of zone A, thereby latching on/in control zone A. The output of zone A is also connected to the anode of D51 with the cathode being connected to R23, which returns to the positive input of the $1^{st}$ comparator of U7 and applies a second positive potential to the positive input. Therefore, when the system is "Disarmed", and zone A of U5 has been latched-in, it still provides the second positive potential, via D51, which applies positive potential to the positive input of the $1^{st}$ comparator, which in turn applies the positive potential to the Input of zone A, for the latch remains on. In like manner, zones B, C, and D provide the same results of each zone. Accordingly, D48 and D51 process zone B, D49 and D54 process zone C, and D50 and D54 process zone D.

The positive input of the $1^{st}$ comparator of U7 is connected to S14, being a single pole single throw normally open switch having a spring return. The switch return is connected to R27, which returns to ground. The return is also connected to the anode of C14, and the cathode is connected to ground. S14 serves as a latch reset, once the system has been "Disarmed".

In describing the operations of U5 and U6, the U6, CD4066, is also a quad bilateral switch utilized as a data selector, as is U5. The Output, zone A of U5 is connected to the Control, zone A of U6, while the Output, zone B of U5 is connected to the Control, zone B, of U6. Likewise, the Output, zone C of U5 is connected to the Control, zone C, of U6, while the Output, Zone D of U5 is connected to the Control, zone D, of U6. When any of the four zoned Outputs of U5 become positive potential, this applies the positive potential to the corresponding zone Control(s) of U6, i.e. zones A, B, C, D.

The operations of U6 and programming switches, S1 through S12, are now described. All switches are preferably single pole single throw. S1 is connected to the Output, zone A of U6. The return is connected to the Output, zone D. Zone D is also connected to the + input of the $3^{rd}$ comparator U7, which shall later be described. S2 is connected to the Output, zone B of U6. The return is connected to the Output, zone D. S3 is connected to the Output, zone C of U6. The return is connected to the Output, zone D. S4 is connected to the Input, Zone A of U6. It is also connected to Vcc, and the return is connected to the Input , zone B. S5 is connected to Vcc, and returns to the Input, zone C, of U6. S6 is connected to Vcc, and returns to the Input, zone D, of U6. S7 is connected to the Input zone B, and returns to the Output zone A of U6. S8 is connected to the Input zone C, and returns to the Output zone A of U6. S9 is connected to the Input zone D, and returns to the Output zone A of U6. S10 is connected to the Input zone C, and returns to the Output zone B of U6. S11 is connected to the Input zone D, and returns to the Output zone B of U6. S12 is connected to the Input zone D, and returns to the Output zone C of U6. The programming and reading of selector switches shall later be described.

In the operations of U6, U7, K1, the Output, zone D of U6 is also connected to the positive input of the $3^{rd}$ comparator of U7. This input is also connected to R32, which returns to ground. R32 provides a negative potential to the positive input for normal off operation, where the output is negative potential. The negative input of the $3^{rd}$ comparator and the negative input of the $4^{th}$ comparator are connected together and returned to negative input of the $1^{st}$ comparator, thereby determining the threshold voltage of the positive inputs of the $3^{rd}$ and $4^{th}$ comparators.

The output of the $3^{rd}$ comparator is connected to the anode of C15, and the cathode is connected to the positive input of the $4^{th}$ comparator. The positive input of the $4^{th}$ comparator is also connected to R33, which returns to ground. C15 and R33 form an R.C. circuit of four seconds. In this manner, when a positive signal is applied at the positive input of the $3^{rd}$ comparator, this changes the output to a positive potential which is applied to the anode of C15, which in turn applies positive potential to the positive input of the $4^{th}$ comparator and which changes the output state to a positive potential for a time period of four seconds, and then returns to a negative state.

The positive input of the $3^{rd}$ comparator is also connected to S13, which returns to the positive input of the $4^{th}$ comparator. When S13 is in the off position, the four second time period is utilized. However, when S13 is in the off position and the positive potential is applied, as described above, it causes the output of the $4^{th}$ comparator to remain on, in a positive state, until the system has been "Disarmed" and reset.

The output of the $4^{th}$ comparator is connected to the relay coil of K1. The return of the coil is connected to Vcc. The anode of D59 is also connected to the output of the $4^{th}$ comparator, and the cathode is connected to Vcc. D59 eliminates voltage spikes across the coil of K1. The relay, K1, is normally on, engaged, when the single pole single throw contacts are closed. The relay contacts are connected to the wiring terminals 6, and 7 of J1, the normally closed output.

In the operation of the $2^{nd}$ comparator, U7, the output of zone D of U6 is also connected to the anode of D58, while the cathode is connected to R34, which returns to ground. R34 determines the voltage to D 58, being a Red L.E.D., providing indication of an alarm activation. The output of zone D of U6 is also connected to S15, which returns to the anode of D39, and the cathode is connected to the negative input of the $1^{st}$ comparator, U4. The return line of S15 is also connected to the anode of D40, and the cathode is connected to the negative input of the $2^{nd}$ comparator of U4. The return side of S15 is also connected to the anode of D41, and the cathode is connected to the negative input of the $3^{rd}$ comparator. The return is also connected to the anode of D42, and the cathode is connected to the negative input of the $4^{th}$ comparator of U4.

When an alarm activation occurs, as indicated by D58 Red L.E.D., a positive potential is applied to the anodes of D39, D40, D41 and D42, and passes forward through the said four diodes, thereby applying a positive potential to the negative inputs of the four comparators of U4, when S15 is on. Therefore, further activations from U2 and U3 will not be detected or registered at any of the four negative input's of U4. When any negative signal is produced via the outputs of U2 or U3, it must pass through the corresponding resistor, R9, R11, R13, or R15, and does not provide sufficient negative potential at the negative inputs of U4 to be detected. When S15 is off, this operation feature does not occur or apply. The programming and readings of selector switches, 1–12, are described in FIG. 4, Truth Table.

Figure 3:
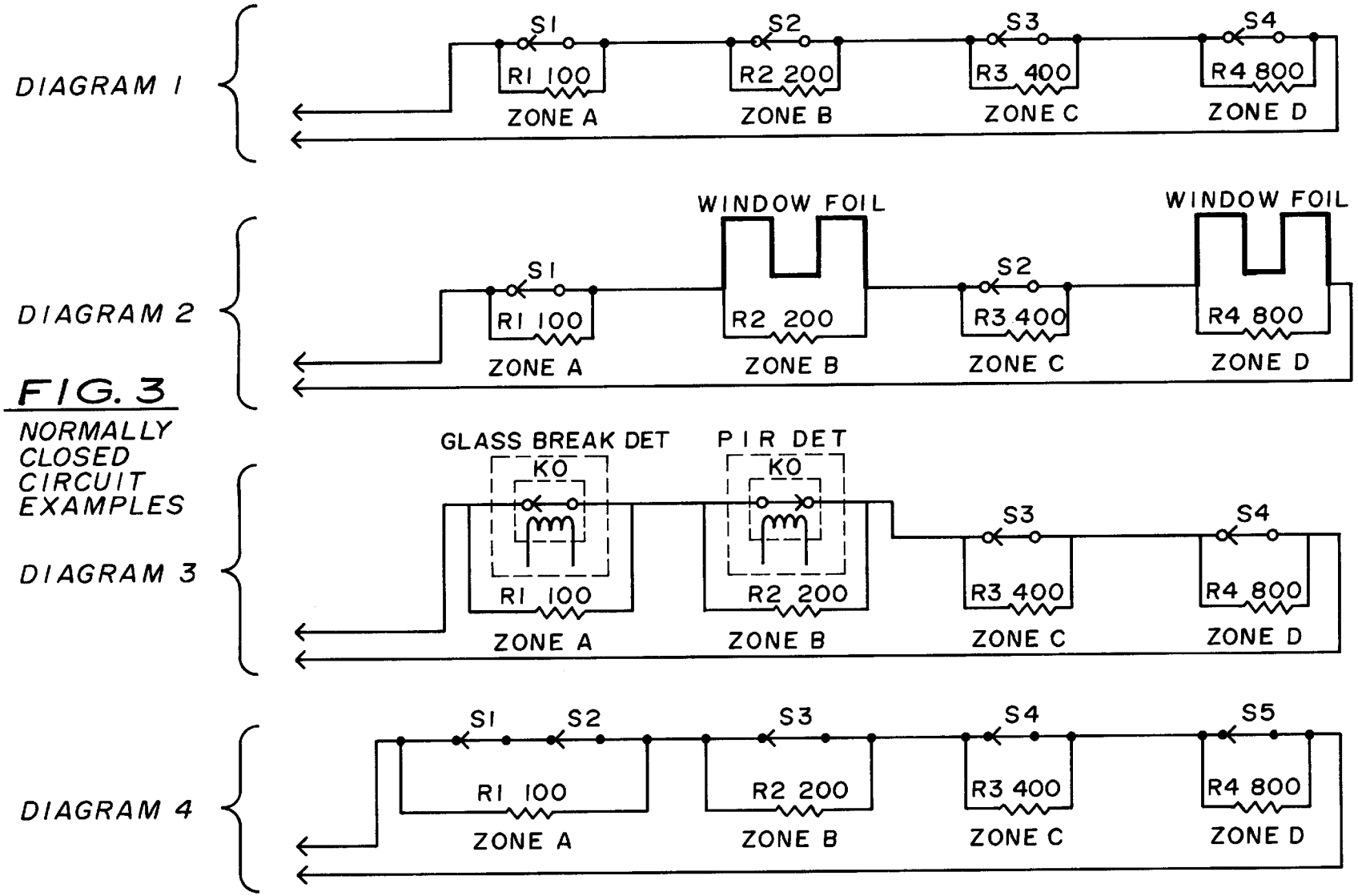
FIG. 3 is a wiring diagram illustrating three examples of zoned circuit devices constructed in accordance with the present invention.
Figure 8:
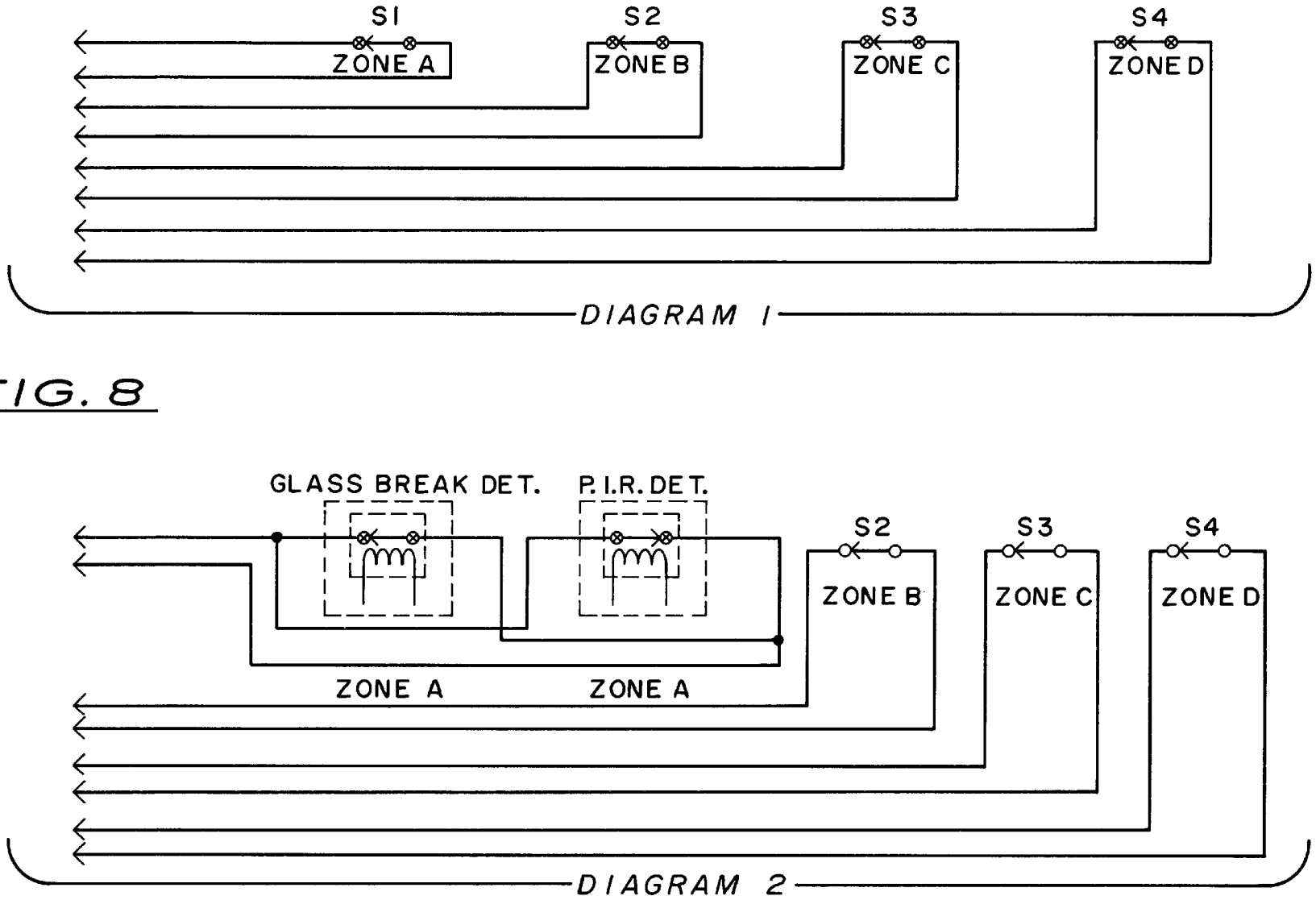
FIG. 8 is a wiring diagram illustrating two examples of wiring arrangements typical in the prior art for a plurality of zone circuit devices.

Referring to FIG. 8, diagram 1 thereof can be compared to diagram 1 of FIG. 3. As can be seen, the conventional wiring arrangement of FIG. 8 requires four separate circuits to the four zones while the arrangement of the present invention requires only one circuit to cover the four zones. Likewise, diagram 2 of FIG. 8 compares to diagram 3 of FIG. 3. It should be noted that the two devices of zone A in diagram 2 of FIG. 8 would require a latch/hold device to cause the circuit to remain an open circuit once activated. Moreover, the conventional wiring arrangement of diagram 2 of FIG. 8 also requires four separate circuits to cover the four zones unlike the present invention.

As can be seen from the above, the present invention provides several distinct advantages. It greatly reduces installation time and cost of present zoned system. The system also reduces servicing time since the system identifies the problem. Another distinct advantage is that the system provides a means of programming any and all possible switching circuit arrangements of the four zoned circuits. When two or more utilized devices are programmed to cause alarm activation, both devices need not be activated simultaneously to cause alarm activation. Therefore, separate latch-in devices are not required for each utilized zoned device in the present invention. Present zoned control panels would require physical rewiring of the utilized devices in the zoned circuit.

The system of the invention also provides a means of monitoring the closed loop circuit even when any or all circuits are open. Only when the closed loop circuit is cut open, a separate light emitting diode indicates a line cut. This design allows continuous twenty-four hour monitoring, and when the system is off, i.e. disarmed, it provides an indication of a problem prior to arming the system. Yet another distinct advantage of the present invention is that it provides a means to easily program or re-program any desired switching arrangements by means of twelve single pole, single throw selector switches, located internally within the system control panel. If or when any of the utilized devices become inoperable, such as in a state of open circuit, and service is required, the particular device may be by-passed by means of re-programming via the selector switches. This allows the system to be "Armed" to provide detection of all utilized devices with the exception of the defective by-passed device or devices. Thus, the system may be utilized until service can be done.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. An apparatus for use in a multi-zone alarm system having a single-pair wire alarm loop and programmable switching circuit arrangements, said apparatus comprising:

a current source serially connected to said single-pair wire loop and selectively operative to provide a predetermined current signal in said loop;

a plurality of zone sensing means arranged in a normally closed series circuit along said single-pair wire loop, each said zone sensing means including resistance means coupled in parallel within each of the normally closed series circuit zone sensing means for providing a specific voltage upon its creating an open circuit in said loop circuit to generate coded voltage changes and alarm activation caused by an open circuit created therein, the resistance exhibited by the resistance means of said plurality of normally closed series connected zone sensing, means being doubled in each sequentially disposed adjacent zone sensing means to create different specific voltages to generate said coded voltage changes;

means for indicating the condition of each said zone sensing means;

means for selectively arming and disarming said zone sensing means;

means for indicating an open circuit in said single-pair wire loop unrelated to the condition of said zone sensing means;

circuit means operative in response to said zone sensing means to provide a signal indication of the zone in which alarm activation has occurred; and means for continuously monitoring all circuit conditions of said apparatus in both said armed and disarmed operative conditions.

2. The apparatus as claimed in claim 1, wherein said open circuit indicating means comprises an adjustable voltage regulator coupled to said single-pair wire loop and including comparator circuit means, and wherein there are four of said zone sensing means, the output of said adjustable voltage regulator producing a voltage of 2.5 at when all circuits are closed, wherein in any single event the first zone (A) open circuit produces 3.0 volts, the second zone (B) produces 3.5 volts, the third zone (C) produces 4.5 volts and the fourth zone (D) produces 6.5 volts at the output of the said regulator, and wherein the resistance of each zone sensing means is calculated as zone A=1X, zone B=2X, zone C=4X, and zone D=8X, the resistance of zone B being two times greater than that of adjacent zone A, the resistance of zone C being two times greater than that of adjacent zone B, and the resistance of zone D being two times greater than that of adjacent zone C.

3. The apparatus as claimed in claim 1, wherein said open circuit indicating means comprises an adjustable voltage regulator coupled to said single-pair wire loop and including comparator circuit means, and wherein said apparatus further includes two dot display drivers, the voltage output of said adjustable voltage regulator being coupled to the signal inputs of said display drivers to provide a linear analog output that senses analog voltage levels, the two drivers being connected in a cascading arrangement providing twenty-step voltage divisions, and wherein each of the said display drivers contains its own adjustable reference and ten-step voltage divider with the outputs of said drivers being arranged in a circuit such that each of the outputs provide linear analog voltages in divisions of 0.5 volts from 0.5 through 10.0 volts.

4. The apparatus as claimed in claim 3, wherein each voltage output of the combined analog voltage divisions are coupled lo the inputs of said independent zone sensing means, providing the means to determine sixteen possible switching circuit arrangements when there are four zone sensing means in said loop circuit.

5. The apparatus as claimed in claim 4, wherein there are preferably four said zone sensing means in said loop circuit with coded voltage changes, and these changes are created when said first (A), second (B), third (C) and fourth (D) sensing means circuits are closed, said loop circuit provides 2.5 volts at the zone detector circuit, when A is open circuit and B,C,D are closed said loop circuit provides 3.0 volts, when B is open circuit and A,C,D are closed said loop circuit provides 3.5 volts, when A and B are open circuit and C and D are closed said loop circuit provides 4.0 volts, when C is open circuit and A,B,D are closed said loop circuit provides 4.5 volts, when A and C are open circuit and B and D are closed said loop circuit provides 5.0 volts, when B and C are open circuit and A and D are closed said loop circuit provides 5.5 volts, when A,B,C are open circuit and D is closed said loop circuit provides 6.0 volts, when D is open circuit and A,B,C are closed said loop circuit provides 6.5 volts, when A and D are open circuit and B and C are closed said loop circuit provides 7.0 volts, when B and D are open circuit and A and C are closed said loop circuit provides 7.5 volts, when A,B,D are open circuit and C is closed said loop circuit provides 8.0 volts, when C and D are open circuit and A and B are closed said loop circuit provides 8.5 volts, when A,C,D are closed circuit and B is open said loop circuit provides 9.0 volts, when B,C,D are open circuit and A is closed said loop circuit provides 9.5 volts, and when A,B, C,D are open circuit said loop circuit provides 10.0 volts.

6. The apparatus as claimed in claim 1, wherein said zone sensing means each contain an R.C. timing circuit and a inverting comparator, and wherein said R.C timing circuits are designed to allow negative potential to be applied to the input of the inverting comparator when a signal is applied in excess of two seconds in time, thereby providing a means to reduce false alarms in said apparatus caused by short term activations.

7. The apparatus as claimed in claim 1, wherein said arming and disarming means comprises a non-inverting comparator wherein the armed mode of operation occurs when a positive potential is applied to the input thereof, said non-inverting comparator being coupled to a single pole single throw normally open push switch to provide apparatus reset after said apparatus has been disarmed.

8. An annunciator for a multi-zone alarm system utilizing a single-pair wire alarm loop through said zones for alarm activation and monitoring, said annunciator comprising:

a current source serially connect ed to said single-pair wire loop and selectively operative to provide a predetermined current signal in said loop;

at least four detection sensors arranged in a normally closed series circuit along said single-pair wire loop, each said detection sensor being associated with one said zone and including resistance means for providing a specific voltage upon its creating an open circuit in said loop circuit, each said detection sensor having a different specific voltage for generating coded voltage changes along the circuit of said loop caused by an open circuit created within said detection sensor;

visual means in the form of at least four individual light emitting diodes for indicating the condition of each said zone detection sensor, the outputs of the circuits of said at least four zone detector sensors, represented by the designators A, B, C and D, being coupled to said individual light emitting diodes;

means for selectively arming and disarming said annunciator;

adjustable voltage regulator means coupled to said single-pair wire loop and including comparator circuit means for indicating an open circuit in said single-pair wire loop caused by cutting of said wire loop unrelated to the condition of said zone detection sensors;

circuit means operative in response to said zone detection sensors to provide a signal indication of the particular zone in which alarm activation has occurred by the generation of said coded voltage changes in one or more of said detection sensors;

means for continuously monitoring all circuit conditions of said annunciator in both said armed and disarmed operative conditions;

means for reducing false alarms in said annunciator caused by short term activations including an R.C. timing circuit and a inverting comparator associated with each said detection sensor, said R.C timing circuits being designed to allow negative potential to be applied to the input of the inverting comparator when a signal is applied in excess of two seconds in time; and a first quad bilateral switch having four control inputs coupled to the outputs of said four zone detector sensors A, B, C, D and the outputs of said first quad bilateral switch coupled to the respective control inputs of said zone detector sensors A, B, C, D to provide means to cause latch-in of the said first bilateral switch when the system is in the armed mode of operation, wherein the activation of any of the four zoned devices A, B, C, D when in the armed mode of operation causes latch-in of the corresponding inputs of said first quad bilateral switch to cause latch-in of each separate zone and individual latch-in of the corresponding zone light emitting diode to indicate said zone condition.

9. The annunciator as claimed in claim 8, wherein said annunciator further includes a second quad bilateral switch and a plurality of at least twelve programming switches, the outputs of said first quad bilateral switch representative of zones A,B,C,D being coupled to the respective control inputs of said second quad bilateral switch which, in conjunction with said programming switches, provide means for programming thirty possible switching arrangements of the four zoned detection sensors.

10. The annunciator as claimed in claim 9, wherein said annunciator further includes an alarm output relay and a processing circuit comprising first and second non-inverting comparators wherein the output of said second quad bilateral switch is coupled to the input of said processing circuit and wherein the output of said first comparator is coupled to the input of said second comparator to form said R.C. timing circuit, said alarm output relay becoming de-energized when an alarm activation occurs to indicate an alarm condition for a time period of approximately four seconds, the normally on relay state also providing means for monitoring a cut wire in the zone loop and low or no voltage to the system when either condition would cause alarm activation.

11. The annunciator as claimed in claim 10, wherein said annunciator further includes means for providing a latch-in of said alarm output relay when an alarm activation has occurred, and wherein the input of the said first comparator is coupled to a single pole single throw switch and returns to the input of the said second comparator to by-pass said R.C. circuit.

12. The annunciator as claimed in claim 9, wherein said annunciator further includes means to cease further additional zone detectors from being activated or registered by said four zone detection sensors once a first alarm condition has occurred and the system has been disarmed.

13. The annunciator as claimed in claim 9, wherein the output of said first quad bilateral switch is coupled to the input of the said non-inverting comparator which provides the means to hold the latch on of said first bilateral switch when the system is disarmed.

14. A four-zone annunciator for use in an alarm system utilizing a single-pair wire alarm loop interconnecting said four zones for alarm activation and monitoring, said four-zone annunciator comprising:

a current source connect ed to said single-pair wire loop and selectively operative to provide a predetermined current signal in said loop;

a plurality of detection sensors arranged in a normally closed series circuit along said single-pair wire loop, each said detection sensor being associated with one said zone and adapted for generating specific voltage changes along the circuit of said loop caused by an open circuit created within said detection sensor, each said sensor having a different specific voltage for identification within said loop circuit and including resistance means coupled in parallel within each of the normally closed series circuit zone detection sensors, the resistance exhibited by said resistance means of the four normally closed series connected detection sensors being doubled in each sequentially disposed adjacent sensor to provide said specific voltage changes;

visual means for indicating the condition of each said zone detection sensor;

means for selectively arming and disarming said annunciator;

adjustable voltage regulator means coupled to said single-pair wire loop and including comparator circuit means for indicating an open circuit in said single-pair wire loop caused by cutting of said wire loop unrelated to the condition of said zone detection sensors;

circuit means operative in response to said zone detection sensors to provide a signal indication of the particular zone in which alarm activation has occurred by the generation of said specific voltage changes in one or more of said detection sensors;

means for continuously monitoring all circuit conditions of said annunciator in both said armed and disarmed operative conditions;

means for reducing false alarms in said annunciator caused by short term activations including an R.C. timing circuit and a inverting comparator associated with each said detection sensor, said R.C timing circuits being designed to allow negative potential to be applied to the input of the inverting comparator when a signal is applied in excess of two seconds in time;

a first quad bilateral switch wherein the outputs of said four zone detector sensor circuits are coupled to four control inputs of said first quad bilateral switch with the outputs of said switch being coupled to the respective control inputs of said detector sensor circuits to enable latch-in of the said first bilateral switch when the system is in an armed mode of operation, and wherein the activation of any of said four detection sensors when in the armed mode of operation will enable latch-in of the corresponding inputs of said first quad bilateral switch to cause latch-in of each separate zone;

a second quad bilateral switch; and a plurality of at least twelve programming switches, the outputs of said first quad bilateral switch representative of the four detection zones being coupled to the respective control inputs of said second quad bilateral switch which, in conjunction with said programming switches, provide means for programming thirty possible switching arrangements of the four zoned detection sensors.

15. An apparatus for use in a multi-zone alarm system having a single-pair wire arranged in a normally closed series alarm loop and having programmable switching circuit arrangements, said apparatus comprising:

a current source serially connected to said single-pair wire loop to provide a predetermined current signal in said loop;

a plurality of zone sensing means arranged in a normally closed series circuit within said single-pair wire loop, each said zone sensing means being adapted for generating predetermined specific coded voltage changes created therein;

means for decoding said voltage changes;

means for indicating the condition of each said zone sensing means;

means for selectively arming and disarming said zone sensing means;

means for providing indication of armed and disarmed modes;

means for indicating an open circuit in said single-pair wire loop unrelated to the condition of said zone sensing means;

circuit means operative in response to said zone sensing means to provide a signal indication of the zones in which activation has occurred;

means for continuously monitoring all said circuit conditions of said apparatus in both said armed and disarmed operative conditions;

means to continuously monitor the voltage condition to said apparatus and provide indication thereof;

means of reducing false alarms caused by short term activations by any of said normally closed sensing means utilized in the zoned loop; and means to provide programming of thirty possible switching arrangements of said zoned closed circuit sensing means utilized in said loop.

16. The apparatus as claimed in claim 15, wherein each said zone sensing means comprises a detection device which includes means for providing a predetermined specific voltage upon its creating an activation, wherein a specified resistance is applied in series of said loop circuit, each said zone sensing device providing a different predetermined specific voltage change for generating said coded voltage changes in said loop.

17. The apparatus as claimed in claim 16, wherein said specific voltage means comprises resistance means coupled in parallel within each of said sensing devices in said normally closed loop, thereby providing said zone sensing means.

18. The apparatus as claimed in claim 16, wherein said normally closed circuit devices in said normally closed loop cause specific output signals when activated to be applied to two voltage divider inputs to reverse voltage polarity of said outputs which is then applied to the inputs to one or more of said timing circuits, being inverting comparators, the outputs providing said indication thereof only when said zoned devices are activated for a time period in excess of 2.0 seconds to cause said indication thereof thereby providing means of reducing false alarms caused by said short term activations of less than 2.0 seconds in time.

19. An annunciator for use in a multi-zone alarm system having a single-pair wire arranged in a normally closed series alarm loop and having programmable switching circuit arrangements wherein normally closed circuit devices in the form of zone sensing devices in the normally closed loop are provided for monitoring system conditions and further provide selective means to cause an alarm activation and indication thereof, said annunciator comprising;

a current source serially connected to a single-pair wire arranged in a normally closed loop and operative to provide predetermined specific current signals in said loop;

a plurality of detection sensors being arranged in a normally closed series circuit within said single-wire loop, each said detection sensor being associated with one said zone and adapted for generating said coded voltage changes within the circuit loop caused by an activation of said detection sensor;

visual means for providing indication of the condition of each said zoned detection sensor;

means for selectively arming and disarming said annunciator and providing indication thereof;

an adjustable voltage regulator means coupled to said single-pair wire normally closed loop and including comparator circuit means for indicating an open circuit is said loop caused by cutting of said wire loop unrelated to the condition of said zone detection sensors;

circuit means operative in response to said zone detection sensors to provide indication as to which particular sensor was activated as determined by the generated voltage signal; and means for continuously monitoring all said circuit conditions as received by said annunciator in both said armed and disarmed operative modes.

20. The annunciator as claimed in claim 19, wherein each said detection sensor includes resistance means for providing a predetermined specific voltage upon its activation wherein the resistance is applied in said series loop circuit, each said detection sensor having a different predetermined value thereby providing said coded voltage changes therein.

21. The annunciator as claimed in claim 19, wherein there are four of said zone detection sensors within said loop circuit, and each of said sensors are designated a specific zone being A, B, C and D, and after said signal processing provides visual indication of each zone's condition by means of four individual light emitting diodes being representative thereof.

22. A four-zone annunciator for use in an alarm system utilizing a single-pair wire arranged in a normally closed alarm loop interconnecting four normally closed zone detection sensors for monitoring and providing condition indication thereof and selectively providing means to cause alarm activation thereof, said four-zone annunciator comprising:

a current source connected to said single-pair wire loop and operative to provide predetermined current signals in said zone loop, the zones being designated A,B,C and D;

a plurality of detection sensors arranged in a normally closed series circuit within said single-pair wire loop, each said detection sensor being associated with one said zone and adapted for generating specific voltage changes within said circuit loop caused by an activation of said detection sensors wherein an open circuit is created therein placing a predetermined resistance in series in said closed loop circuit, each said sensor having a different calculated specific resistance value thereby providing indication and identification of the activated zone detection sensors;

visual means for indicating the condition of each said zoned detection sensor;

means for selectively arming and disarming said annunciator;

an adjustable voltage regulator means coupled to said singe-pair wire loop and including comparator circuit means for indicating an open circuit in said wire loop caused by cutting of said wire loop unrelated to the activation condition of said zoned detection sensors;

circuit means operative in response to said detection sensors to provide signal indication of the particular zones which caused alarm activation on and provide latch-in of said zone indicators;

means for reducing false alarms in said annunciator caused by short term activations including four R.C. timing circuits and inverting comparators being associated with each said detection sensor, said R.C. timing circuits designed to allow negative potential to be applied to the inputs of the inverting comparators when a signal is applied in excess of two seconds in time; and a first quad bilateral switch wherein the outputs of each said R.C. timing circuit is representative of each zone A,B,C,D and are coupled to each of the four corresponding control inputs of said first quad bilateral switch, each corresponding switch input poles designated a,b,c,d being coupled to the arming and disarming circuits wherein when in the armed mode, a positive potential is applied to said input poles, and the output poles a,b,c,d, of said switch being coupled to each of the four respective control inputs, and wherein the activation of any of said four detection sensors when in the armed mode of operation will enable latch-in of the corresponding input controls to provide said indication of each zone thereof.

23. The four-zone annunciator as claimed in claim 22, wherein said specific voltage means of each said detection sensor comprises resistance means coupled in parallel within each of the normally closed series circuit zone detection sensors, and wherein the resistance exhibited by said resistance means of the four normally closed series connected detection sensors are doubled in each sequentially disposed adjacent sensor to provide said specific voltage changes.

24. The annunciator as claimed in claim 22, wherein said first quad bilateral switches a,b,c,d output poles are coupled to the input of said arming and disarming circuit, being a said non-inverting comparator, wherein a second positive potential is applied to said input such that once an activation has occurred and the annunciator has been disarmed, the latch-ins remain on until a manual reset switch is utilized to cause reset.

* * * * *